US006659620B2

(12) United States Patent
Goto

(10) Patent No.: US 6,659,620 B2
(45) Date of Patent: Dec. 9, 2003

(54) PORTABLE LIGHTING APPARATUS AND DESK-TYPE LIGHTING APPARATUS

(76) Inventor: Teruki Goto, 1-447-2-2 Amanuma-cho, Omiya-shi, Saitama (JP)

( * ) Notice: Subject to any disclaimer, the term of this patent is extended or adjusted under 35 U.S.C. 154(b) by 0 days.

(21) Appl. No.: 09/801,255

(22) Filed: Mar. 7, 2001

(65) Prior Publication Data

US 2001/0036071 A1 Nov. 1, 2001

(51) Int. Cl.[7] ..... G03B 15/02

(52) U.S. Cl. ..... 362/127; 362/234; 362/249; 362/8; 362/11; 396/4

(58) Field of Search ..... 362/97, 127, 234, 362/249, 198, 252, 287, 419, 3, 8, 11, 154, 155; 396/3, 4, 2

(56) References Cited

U.S. PATENT DOCUMENTS 3,643,085 A * 2/1972 Durand ..... 362/97
3,964,193 A * 6/1976 Degenhardt et al. ..... 362/97
4,043,662 A * 8/1977 Garfall ..... 362/11
4,654,762 A * 3/1987 Laverick ..... 362/97
5,253,753 A * 10/1993 Brownfield ..... 362/97
5,664,232 A 9/1997 Goto
5,704,702 A * 1/1998 Goto ..... 362/5
5,828,908 A * 10/1998 Mauchan ..... 396/2

* cited by examiner

*Primary Examiner*—Thomas M. Sember
(74) *Attorney, Agent, or Firm*—Jordan and Hamburg LLP

(57) ABSTRACT

A portable lighting apparatus includes a storage case section, and a lid section connected to the storage case section such that the lid section can be opened and closed. The storage case section includes a power supply, a plurality of lighting units connected to the power supply, and a photographing stage. The lid section includes a back screen arranged in front thereof. When fashioned as a desk-type lighting apparatus, a storage desk section is used in place of the storage case section, and the lid is attached thereto in a manner permitting opening and closing thereof.

19 Claims, 7 Drawing Sheets

PORTABLE LIGHTING APPARATUS AND DESK-TYPE LIGHTING APPARATUS

BACKGROUND OF THE INVENTION

1. Field of the Invention

The present invention relates to portable and desk-type lighting apparatuses.

2. Background of the Invention

In Japanese Patent No. 2918820, the present inventor discloses box-shaped mini-studio equipment which can be used as a transportable lighting or studio apparatus.

The mini-studio equipment is composed of an upper box, a middle box, and a lower box. An upper light source is attached to the ceiling of the upper box; and the bottom wall of the upper box is formed of a light diffusion plate for diffusing light emitted from the upper light source. The ceiling portion of the middle box is covered with the diffusion plate of the upper box; and the bottom wall of the middle box is formed of a photographing stage. The photographing stage diffuses light emitted from a lower light source and has a curved portion and a backdrop portion covering a side wall of the middle box. The ceiling portion of the lower box is covered with the photographing stage of the middle box; and the lower light source is attached to the bottom wall of the lower box.

A digital camera or the like is fixed to a side wall portion of the middle box; and an object placed on the photographing stage is lighted optimally through adjustment of the outputs of the upper and lower light sources. The mini-studio equipment enables even a person who does not have expert knowledge of lighting to easily take a digital picture or silver-salt picture of high quality comparable to that of a picture taken by a professional photographer.

However, since the above-mentioned conventional mini-studio equipment assumes a box-like shape and is composed of an upper box, a middle box, and a lower box, the overall size of the equipment is as large as a small-sized refrigerator. Therefore, although the mini-studio equipment is transportable, casters must be attached to the bottom of the lower box when the mini-studio equipment is to be moved within the same building. Further, when the mini-studio equipment is moved to another location, the mini-studio equipment must be loaded onto a vehicle.

SUMMARY OF THE INVENTION

An object of the present invention is to provide a portable lighting apparatus which solves the above-described problems involved in conventional techniques, which can be carried as hand luggage, and which enables an ordinary amateur photographer to utilize the lighting techniques of professional photographers and to take high-quality digital or silver-salt pictures. Another object of the present invention is to provide a desk-type lighting apparatus which facilitates teaching of lighting techniques at an education site.

In order to achieve the above object, a portable lighting apparatus of the present invention comprises a storage case section, and a lid section connected to the storage case section such that the lid section can be opened and closed, wherein the storage case section includes a power supply, a plurality of lighting units connected to the power supply, and a photographing stage; and the lid section includes a back screen.

In another portable lighting apparatus of the present invention, the storage case section has a storage space for storing the lighting units.

In still another portable lighting apparatus of the present invention, the power supply is fixedly disposed at the left-hand end and right-hand end, respectively, of the storage space; the lighting units include lower lighting units connected directly to the power supplies, and upper lighting units connected to the power supplies via arm portions; and the photographing stage is attached to the power supplies such that the photographing stage covers the lower lighting units and extends between the left-hand and right-hand power supplies, wherein when the lighting units are stored, the photographing stage is removed and stored within the lid section.

A desk-type lighting apparatus of the present invention comprises a storage desk section, and a lid section connected to the storage desk section such that the lid section can be opened and closed, wherein the storage desk section includes a power supply, a plurality of lighting units connected to the power supply, and a photographing stage; and the lid section includes a back screen.

In another desk-type lighting apparatus of the present invention, the storage desk section has a storage space for storing the lighting units.

In still another desk-type lighting apparatus of the present invention, the power supply is fixedly disposed at the left-hand end and right-hand end, respectively, of the storage space; the lighting units include lower lighting units connected directly to the power supplies, and upper lighting units connected to the power supplies via arm portions; and the photographing stage is attached to the power supplies such that the photographing stage covers the lower lighting units and extends between the left-hand and right-hand power supplies, wherein when the lighting units are stored, the photographing stage is removed and stored within the lid section.

In still another portable or desk-type lighting apparatus of the present invention, the photographing stage is a transparent acrylic plate.

In still another portable or desk-type lighting apparatus of the present invention, the back screen is hung from the upper end of the lid section.

In still another portable or desk-type lighting apparatus of the present invention, the back screen is formed of resin film, paper, or cloth.

DESCRIPTION OF THE PREFERRED EMBODIMENTS

Embodiments of the present invention will be described with reference to the drawings.

Figure 1:
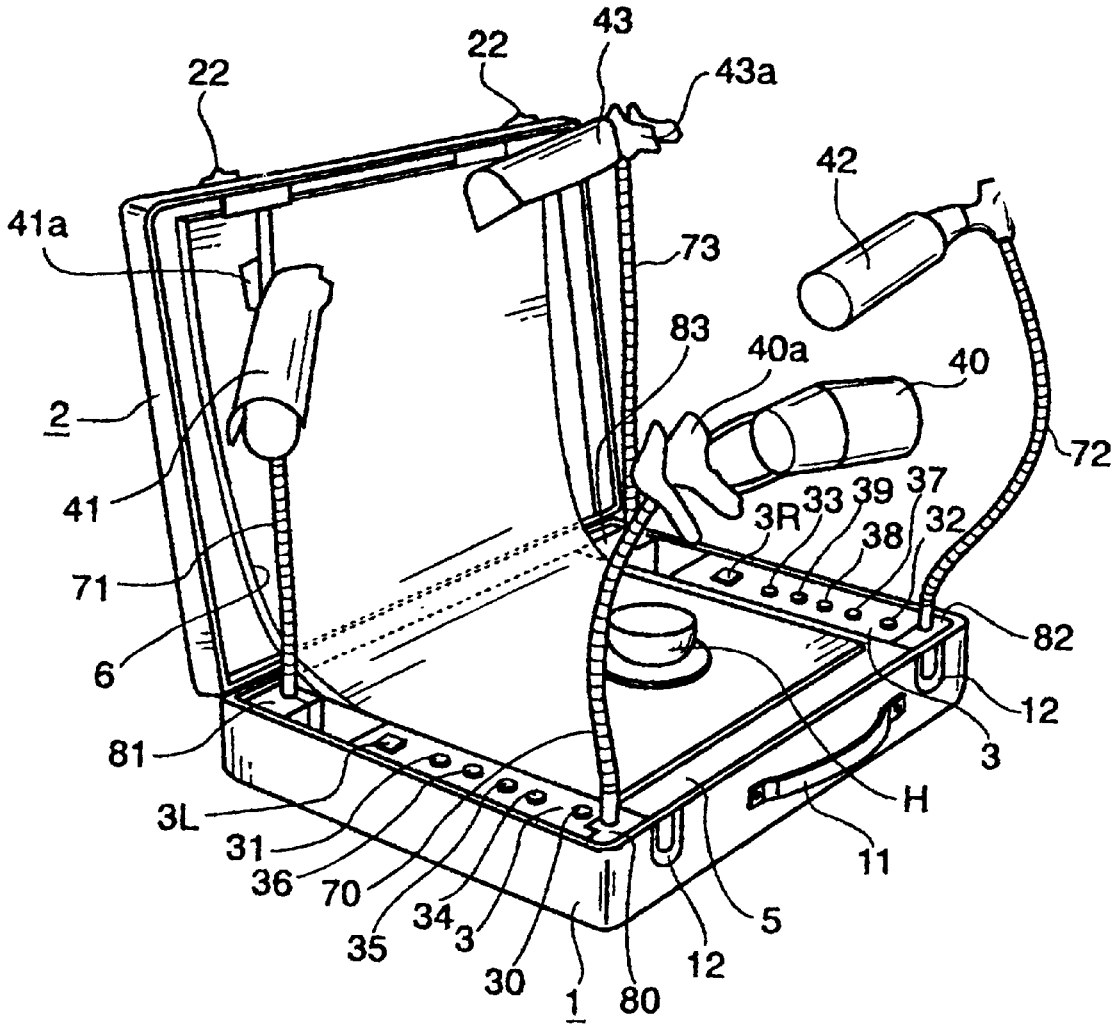
FIG. 1 is a perspective view showing a portable lighting apparatus according to an embodiment of the present invention during use.
Figure 2:
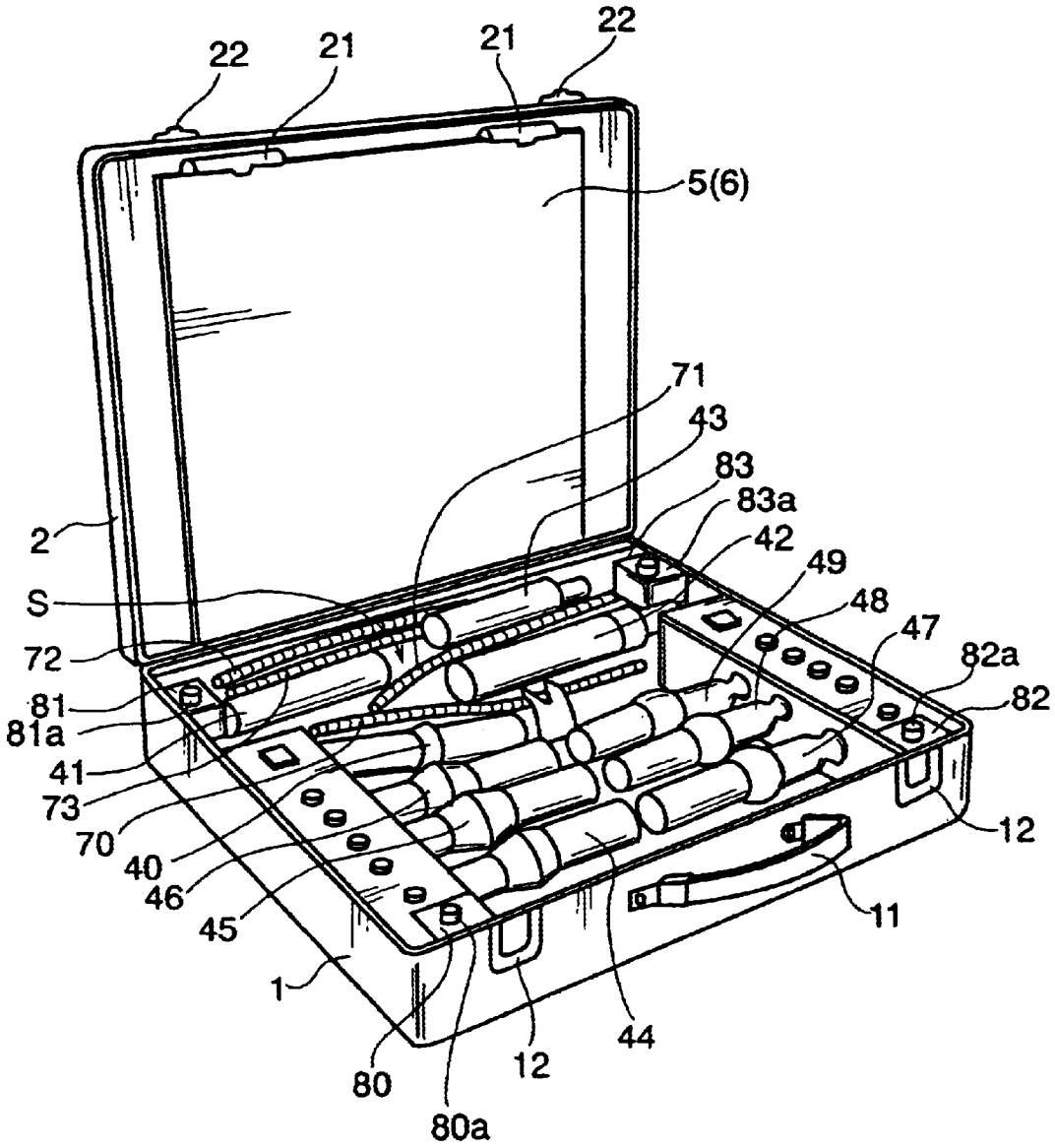
FIG. 2 is a perspective view showing the portable lighting apparatus according to the embodiment of the present invention when not being used (in a state in which lighting units are stored)

As shown in FIGS. 1 and 2, a portable lighting apparatus includes a storage case section 1, and a lid section 2, which is connected (hinged in the illustrated case) to the storage case section 1 such that the lid section 2 can be opened and closed relative to the storage case section 1. When the portable lighting apparatus is constructed to have the shape of an attaché case as in the present embodiment, the portable lighting apparatus can have excellent portability. As shown in FIG. 2, a handle 11 is attached to the center of the front face of the storage case section 1, and lock receiving members 12 are attached to the front face on the right-hand and left-hand sides, respectively, of the handle 11. After storage of lighting units, the lid section 2 is closed, and paired locks 22 attached to the front face of the lid section 2 on the right-hand and left-hand sides, respectively, are engaged with the lock receiving members 12 in order to lock the portable lighting apparatus. A user carries the portable lighting apparatus while holding the handle 11.

In order to achieve a good balance of light weight and durability, the outer frames of the storage case section 1 and the lid section 2 are preferably formed of duralumin, hard plastic, or a material used in attaché cases.

The storage case section 1 includes power supplies 3, a plurality of lighting units 40 to 49 connected to the power supplies 3, and a photographing stage 5. The lid section 2 has a back screen 6. The storage case section 1 has a storage space S. When the lighting units 40 to 43 are not used, the lighting units 40 to 43 are stored within the storage space S in the vicinity of the bottom thereof (in the vicinity of the location where the storage case section is hinged to the lid section).

One of the power supplies 3 is fixedly disposed at the left-hand end of the storage space S, and the other power supply 3 is fixedly disposed at the right-hand end of the storage space S. The power supplies 3 each assume a generally rectangular parallelepipedic shape. The lighting units 40 to 49 include lower lighting units 45 to 49 connected directly to the power supplies 3, and upper lighting units 40 to 43 connected to the power supplies 3 via respective arm portions 70 to 73.

Button switches 30, 31, and 34 to 36 for turning on and off the five lighting units 40, 41, and 44 to 46 located on the left-hand side are provided on the top face of the left-hand power supply 3. Further, a power switch 3L for turning on and off the left-hand power supply 3 itself is provided on the top face of the left-hand power supply 3.

Similarly, button switches 32, 33, and 37 to 39 for turning on and off the five lighting units 42, 43, and 47 to 49 located on the right-hand side are provided on the top face of the right-hand power supply 3. Further, a power switch 3R for turning on and off the right-hand power supply 3 itself is provided on the top face of the right-hand power supply 3.

Sockets for the lower lighting units 44 to 49 are fixed to the side faces of the power supplies 3 such that the three lower, left-hand lighting units 44 to 46 are opposed to the three lower, right-hand lighting units 47 to 49 (see FIG. 2). Preferably, each of the lower lighting units 44 to 49 is a removable fluorescent light. However, each of the lower lighting units 44 to 49 may be a lighting unit of another type, such as a flash unit, a strobe unit, or an incandescent lamp, which is used in photographing.

The upper lighting units 40 to 43 are disposed via the arm portions 70 to 73, which are removably attached to attachment blocks 80 to 83 provided at four corners of the storage case section 1. Male screws 80*a* to 83*a* are projected from the attachment blocks 80 to 83, respectively; and the lower ends of the arm portions 70 to 73 are screw-engaged with the male screws 80*a* to 83*a*, respectively. The upper lighting units 40 to 43 are fixed to the upper end portions of the arm portions 70 to 73 at predetermined positions, by means of clip portions 40*a* to 43*a* thereof, which nip the arm portions 70 to 73, respectively.

In order to increase the number of variations of lighting, a panhead may be fitted onto each male screw through screw-engagement, and the lower end of the arm portion may be fixed to the panhead. Further, an attachment portion (s) for attachment of an upper lighting unit(s) may be provided on the outside surface of the storage case section 1 to which the handle 11 is attached, or on any other outside surface. This arrangement is employed in order to cope with lighting of a relatively large object.

Preferably, each of the upper lighting units 40 to 43 is a removable fluorescent light. However, each of the upper lighting units 40 to 43 may be a lighting unit of another type, such as a flash unit, a strobe unit, or an incandescent lamp, which is used in photographing. Preferably, the arm portions 70 to 73 are each formed of a flexible grip shaft or the like, which enables fine adjustment of position and angle of the corresponding upper lighting unit. Moreover, each of the upper lighting units is preferably designed to be tiltable relative to the clip portion.

The photographing stage 5 is attached to the right-hand and left-hand power supplies 3 such that the photographing stage 5 covers the lower lighting units 44 to 49 and extends between the right-hand and left-hand power supplies 3. When an object H (a cup and saucer in FIG. 1) is to be photographed, the object H is placed on the photographing stage 5. When the lower lighting units 44 to 49 are to be stored within the storage case section 1, the photographing stage 5 is removed and stored, while being nipped by paired clips 21 fixed to the upper end of the lid section 2. The photographing stage 5 is preferably formed of a transparent acrylic plate. However, other transparent plates such as glass plate may be used.

During photographing, the back screen 6 is hung from the paired clips 21 fixed to the upper end of the lid section 2, and the lower portion of the back screen 6 is extended over the photographing stage 5. When the back screen 6 is to be stored, the back screen 6 is removed from the paired clips 21. The thus-removed back screen 6 is rolled into a cylindrical shape, and is stored within the storage space S. Alternatively, the lower end portion of the back screen 6 is partially rolled or folded, while the state of the back screen 6 being hung from the paired clips 21 is maintained. In this state, the back screen 6 is stored.

The back screen 6 is preferably formed of resin film, paper, or cloth. The color of the back screen 6 is selected freely from among opaline, black, and other colors, in accordance with the color of the object H. Example methods of hanging the back screen 6 include a method in which magnetic pieces bonded to the upper end of the back screen are caused to adhere to iron pieces bonded to the upper end of the lid section 2 by means of magnetic force, and a method utilizing hooks or magic tape (Trademark).

In the above-described embodiment, two separate power supplies (i.e., left-hand and right-hand power supplies) are used. In another embodiment, a single power supply may be disposed within the storage case section. In this case, the photographing stage is attached to the right-hand and left-hand ends of the storage case section such that the photographing stage covers the lower lighting units connected to the power supply and extends between the right-hand and left-hand ends. The upper lighting units are attached to attachment portions provided on the outside surface of the storage case section.

Next, other embodiments of the present invention will be described in detail with reference to FIGS. 3 to 7.

Figure 3:
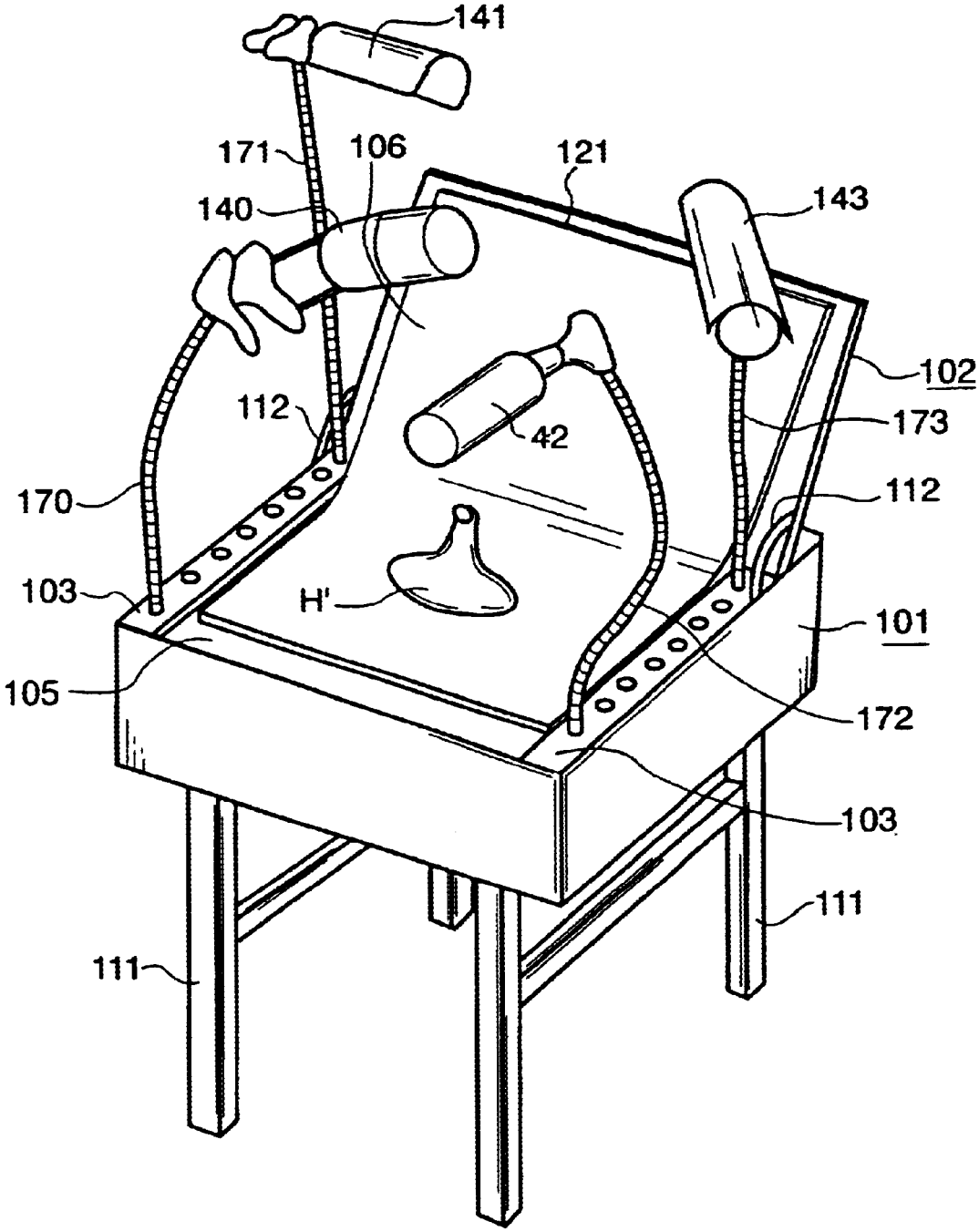
FIG. 3 is a view showing a desk-type lighting apparatus according to another embodiment of the present invention during use.
Figure 4:
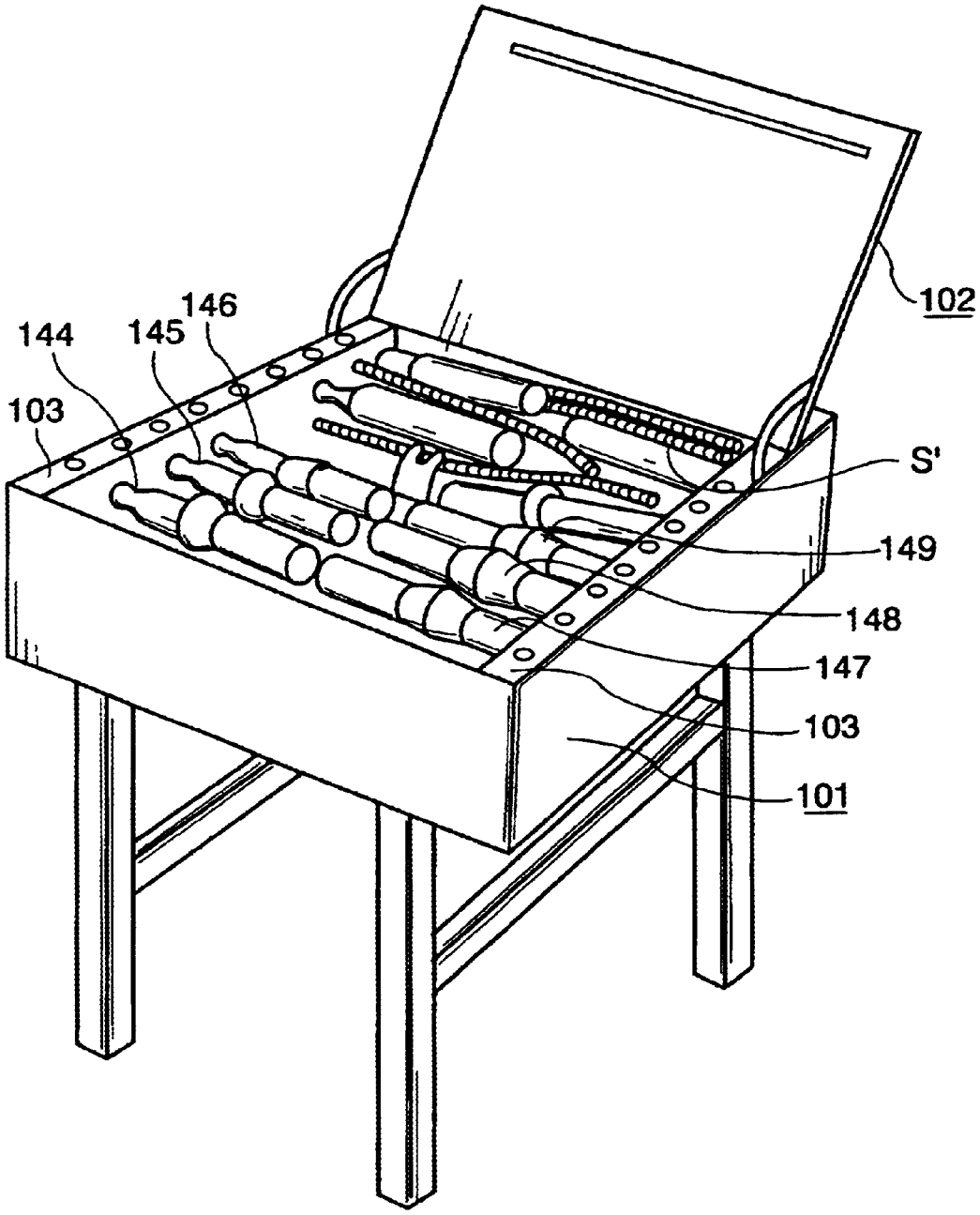
FIG. 4 is a perspective view showing the desk-type lighting apparatus of FIG. 3 when not being used (in a state in which lighting units are stored)
Figure 5:
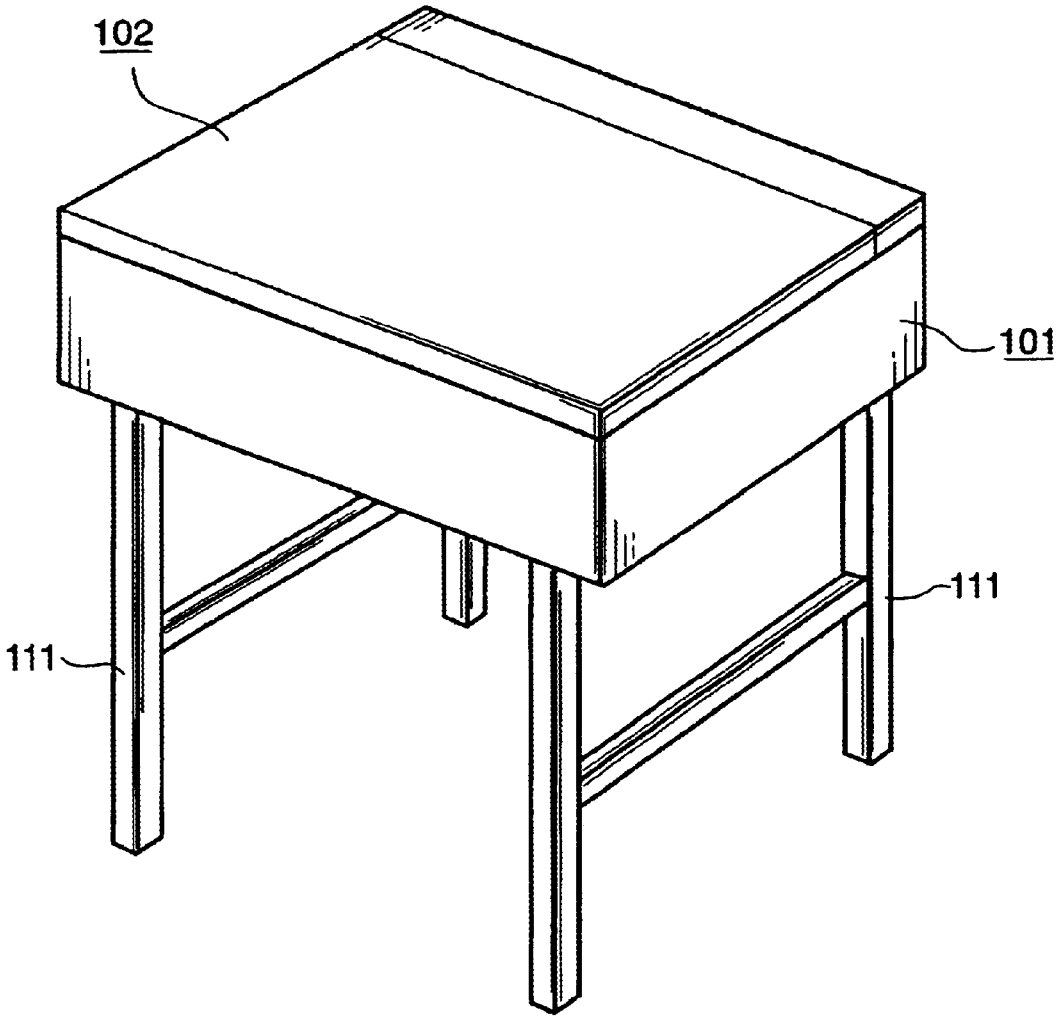
FIG. 5 is a perspective view showing the state in which the lid section of the desk-type lighting apparatus of FIG. 4 has been closed.

A desk-type lighting apparatus shown in FIGS. 3 to 5 includes a storage desk section 101, and a lid section 102, which is connected to the storage desk section 101 such that the lid section 102 can be opened and closed relative to the storage desk section 101. Use of a desk-type lighting apparatus as in the present embodiment facilitates teaching lighting techniques for photographing in, for example, a classroom of a school. As shown in FIG. 3, the storage desk section 101 has legs 111, and is connected to the lid portion 102 by means of left-hand and right-hand hinge members 112. After storage of lighting units, the lid section 102 is closed, and the lighting apparatus is used as a desk, as shown in FIG. 5.

The storage desk section 101 and the lid section 102 are preferably formed of wood, steel, or a material used in conventional desks.

The storage desk section 101 includes power supplies 103, a plurality of lighting units 140 to 149 connected to the power supplies 103, and a photographing stage 105. The lid section 102 has a back screen 106. The storage desk section 101 has a storage space S'. When the lighting units 140 to 143 are not used, the lighting units 140 to 143 are stored within the storage space S' in the vicinity of the bottom thereof (in the vicinity of the location where the storage desk section is connected to the lid section).

One of the power supplies 103 is fixedly disposed at the left-hand end of the storage space S', and the other power supply 103 is fixedly disposed at the right-hand end of the storage space S'. The power supplies 103 each assume a generally rectangular parallelepipedic shape. The lighting units 140 to 149 include lower lighting units 145 to 149 connected directly to the power supplies 103, and upper lighting units 140 to 143 connected to the power supplies 103 via respective arm portions 170 to 173.

Button switches for turning on and off the five lighting units 140, 141, and 144 to 146 located on the left-hand side are provided on the top face of the left-hand power supply 103. Further, a power switch for turning on and off the left-hand power supply 103 itself is provided on the top face of the left-hand power supply 103.

Similarly, button switches for turning on and off the five lighting units 142, 143, and 147 to 149 located on the right-hand side are provided on the top face of the right-hand power supply 103. Further, a power switch for turning on and off the right-hand power supply 103 itself is provided on the top face of the right-hand power supply 103.

Sockets for the lower lighting units 144 to 149 are fixed to the side faces of the power supplies 103 such that the three lower, left-hand lighting units 144 to 146 are opposed to the three lower, right-hand lighting units 147 to 149 (see FIG. 4). Preferably, each of the lower lighting units 144 to 149 is a removable fluorescent light. However, each of the lower lighting units 144 to 149 may be a lighting unit of another type, such as a flash unit, a strobe unit, or an incandescent lamp, which is used in photographing.

The upper lighting units 140 to 143 are disposed via the arm portions 170 to 173, which are removably attached to attachment blocks provided at four corners of the storage desk section 101. An attachment portion(s) for attachment of an upper lighting unit(s) may be provided on the front outside surface or any other outside surface of the storage desk section 101. This arrangement is employed in order to cope with lighting of a relatively large object.

Preferably, each of the upper lighting units 140 to 143 is a removable fluorescent light. However, each of the upper lighting units 140 to 143 may be a lighting unit of another type, such as a flash unit, a strobe unit, or an incandescent lamp, which is used in photographing. Preferably, the arm portions 170 to 173 are each formed of a flexible grip shaft or the like, which enables fine adjustment of position and angle of the corresponding upper lighting unit. Moreover, each of the upper lighting units is preferably designed to be tiltable relative to the clip portion.

The photographing stage 105 is attached to the right-hand and left-hand power supplies 103 such that the photographing stage 105 covers the lower lighting units 144 to 149 and extends between the right-hand and left-hand power supplies 103. When an object H' (a flower vase in FIG. 3) is to be photographed, the object H' is placed on the photographing stage 105. When the lower lighting units 144 to 149 are to be stored within the storage desk section 101, the photographing stage 105 is removed and stored, while being nipped by paired clips 121 fixed to the upper end of the lid section 102. The photographing stage 105 is preferably formed of a transparent acrylic plate. However, other transparent plates such as glass plate may be used.

During photographing, the back screen 106 is hung from the paired clips 121 fixed to the upper end of the lid section 102, and the lower portion of the back screen 106 is extended over the photographing stage 105. When the back screen 106 is to be stored, the back screen 106 is removed from the paired clips 121. The thus-removed back screen 106 is rolled into a cylindrical shape, and is stored within the storage space S'. Alternatively, the lower end portion of the back screen 106 is partially rolled or folded, while the state of the back screen 106 being hung from the paired clips 121 is maintained. In this state, the back screen 106 is stored.

In the above-described embodiment, two separate power supplies (i.e., left-hand and right-hand power supplies) are used. In another embodiment, a single power supply may be disposed within the storage desk section. In this case, the photographing stage is attached to the right-hand and left-hand ends of the storage desk section such that the photographing stage covers the lower lighting units connected to the power supply and extends between the right-hand and left-hand ends. The upper lighting units are attached to attachment portions provided on the outside surface of the storage desk section.

Finally, another embodiment of the desk-type lighting apparatus will be described briefly with reference to FIGS. 6 and 7.

Figure 6:
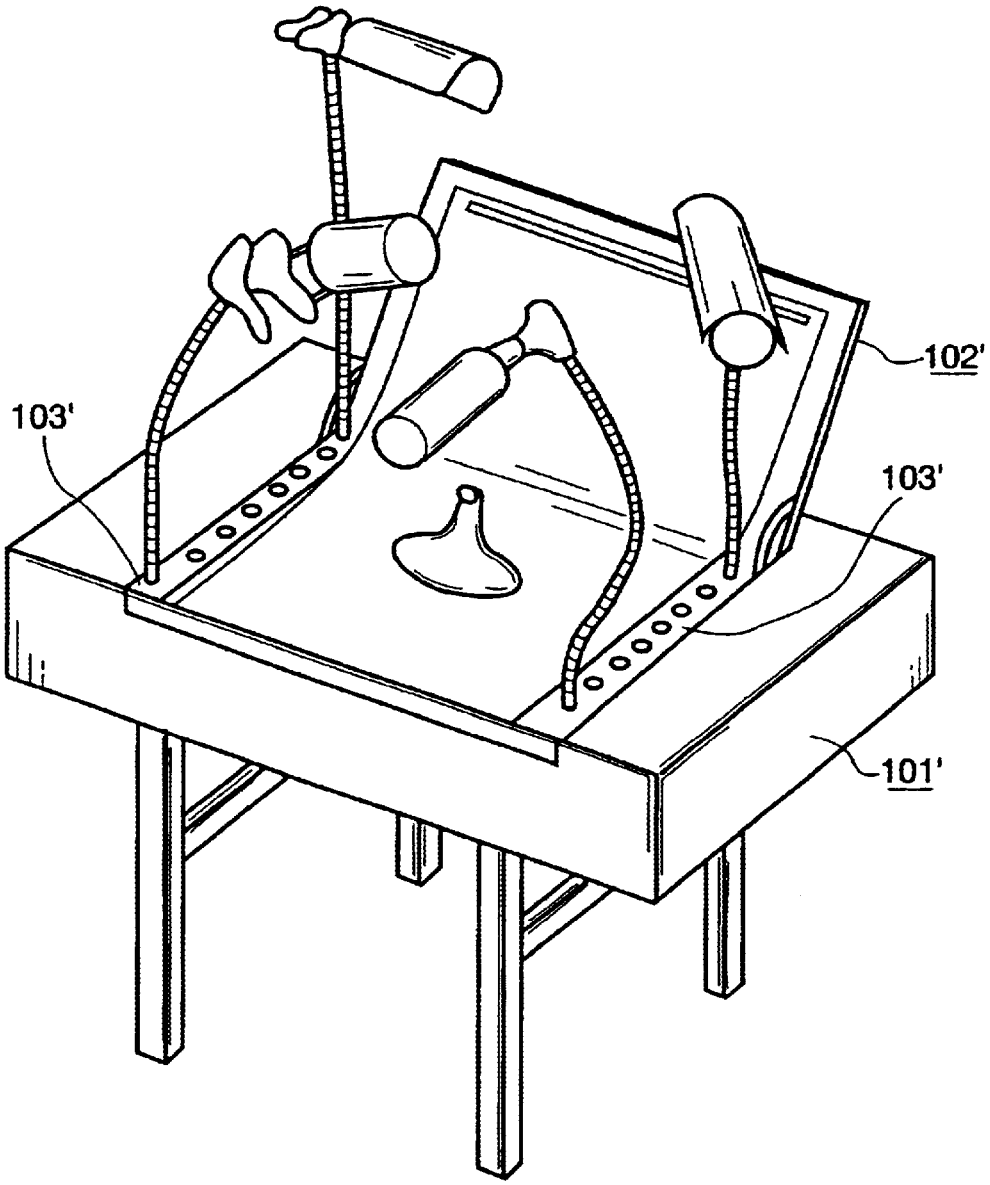
FIG. 6 is a view showing a desk-type lighting apparatus according to still another embodiment of the present invention during use.
Figure 7:
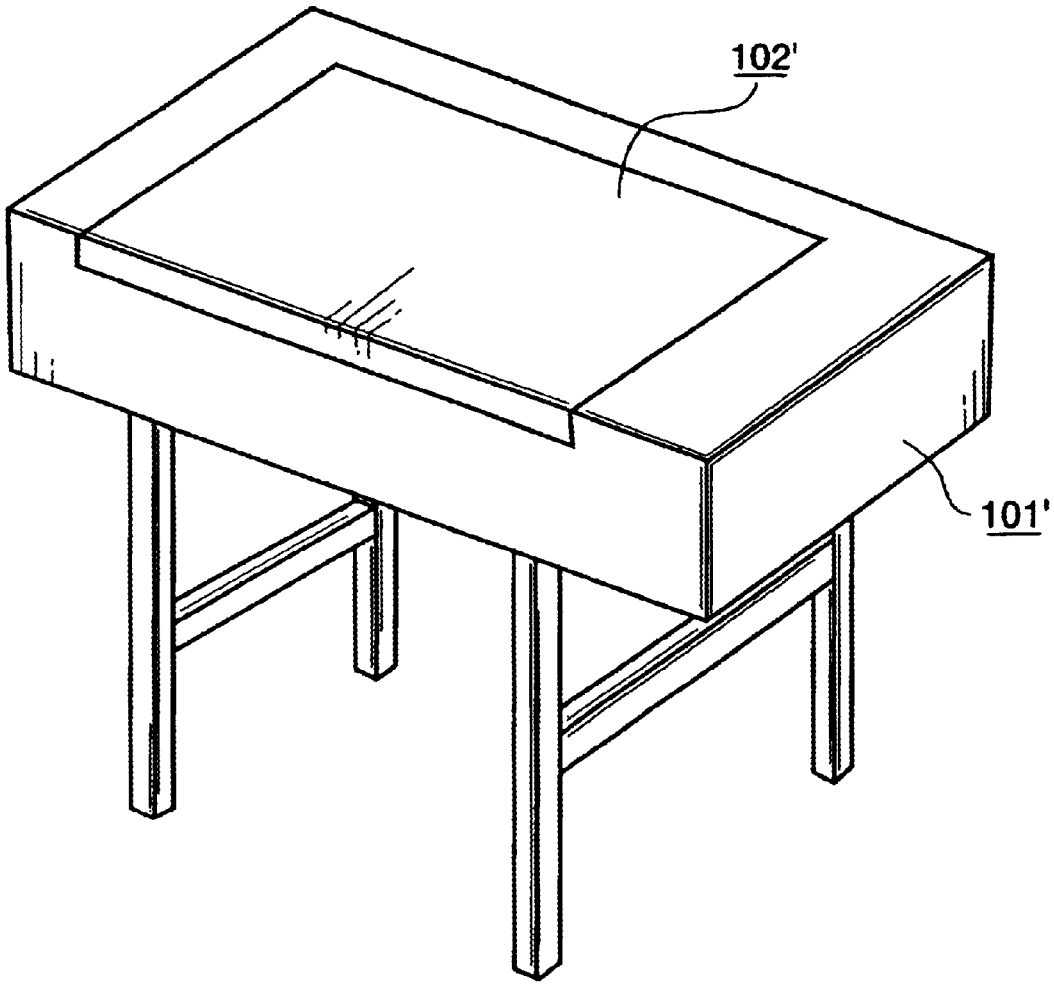
FIG. 7 is a perspective view showing the state in which the lid section of the desk-type lighting apparatus of FIG. 6 has been closed.

The desk-type lighting apparatus shown in FIGS. 6 and 7 has the same basic configuration as that of the desk-type lighting apparatus of FIG. 3. The difference lies in that the width of the lid portion 102' is smaller than that of the storage desk section 101', because left-hand and right-hand power supplies 103' are not fixedly disposed at the left-hand end and right-hand end of the storage desk section 101' but are fixedly disposed at left-hand and right-hand positions which are shifted slightly inward from the left-hand and right-hand ends. In the desk-type lighting apparatus of FIG. 3, the width of the lid portion is the same as that of the storage desk section.

As described above in detail, the portable lighting apparatus of the present invention comprises a storage case section, and a lid section connected to the storage case section such that the lid section can be opened and closed, wherein the storage case section includes a power supply, a plurality of lighting units connected to the power supply, and a photographing stage; and the lid section includes a back screen.

Therefore, a user can carry the lighting apparatus as hand luggage. Further, an amateur photographer can utilize the lighting techniques of professional photographers and can take high-quality digital or silver-salt pictures.

In another portable lighting apparatus of the present invention, the storage case section has a storage space for storing the lighting units when they are not used. Therefore, lighting units, which are relatively bulky units of the lighting apparatus, can be stored within a small space, thus enhancing portability.

In still another portable lighting apparatus of the present invention, the power supply is fixedly disposed at the left-hand end and right-hand end, respectively, of the storage case section; the lighting units include lower lighting units connected directly to the power supplies, and upper lighting units connected to the power supplies via arm portions; and the photographing stage is attached to the power supplies such that the photographing stage covers the lower lighting units and extends between the left-hand and right-hand power supplies, wherein when the lighting units are stored, the photographing stage is removed and stored within the lid section.

This arrangement reduces the thickness of the portable lighting apparatus to thereby enhance portability.

In still another portable lighting apparatus of the present invention, the photographing stage is an opaline, transparent acrylic plate. Since a portion of light emitted from the lower lighting units can be caused to pass through the photographing stage, there can be realized various modes of lighting which cannot be obtained by use of direct light from the upper lighting units.

In still another portable lighting apparatus of the present invention, the back screen is hung from the upper end of the lid section. This eliminates the necessity of preparing a screen or hooks for hanging the back screen at a photographing site.

In still another portable lighting apparatus of the present invention, the back screen is formed of resin film, paper, or cloth. In this case, since the back screen can be rolled in a cylindrical shape or folded before being stored within the storage case section, excellent portability is attained.

The desk-type lighting apparatus of the present invention comprises a storage desk section, and a lid section connected to the storage desk section such that the lid section can be opened and closed, wherein the storage desk section includes a power supply, a plurality of lighting units connected to the power supply, and a photographing stage; and the lid section includes a back screen. This arrangement facilitates introduction of a lighting apparatus to education sites.

What is claimed is:

1. A portable lighting apparatus, comprising:

a storage case section including a power supply, a plurality of lighting units connected to said power supply, and a photographing stage;

a lid section connected to said storage case section such that said lid section can be opened and closed; and a back screen disposable in a position forward of said lid section when said lid section is opened, a lower portion of said back screen being extendable over at least a portion of said photographing stage.

2. A portable lighting apparatus according to claim 1, wherein said storage case section has a storage space for storing said lighting units.

3. A portable lighting apparatus according to claim 1, wherein said back screen is hung from an upper end of said lid section.

4. A portable lighting apparatus according to claim 3, wherein said back screen is formed of resin film, paper, or cloth.

5. A portable lighting apparatus, comprising:

a storage case section including power supplies, a plurality of lighting units connected to said power supplies, and a photographing stage, said storage case section having a storage space for storing said lighting units, said power supplies being fixedly disposed at a left-hand end and a right-hand end, respectively, of said storage space, said lighting units including lower lighting units connected directly to said power supplies, and upper lighting units connected to said power supplies via arm portions; and a lid section connected to said storage case section such that said lid section can be opened and closed, said lid section including a back screen, said photographing stage being attached to said power supplies such that said photographing stage covers said lower lighting units and extends between the left-hand and right-hand power supplies, such that when said lighting units are stored, said photographing stage is removed and stored within said lid section.

6. A portable lighting apparatus according to claim 5, wherein said photographing stage is a transparent acrylic plate.

7. A desk-type lighting apparatus, comprising:

a storage desk section including a power supply, a plurality of lighting units connected to said power supply, and a photographing stage;

a lid section connected to said storage desk section such that said lid section can be opened and closed; and a back screen disposable in a position forward of said lid section when said lid section is opened, a lower portion of said back screen being extendable over at least a portion of said photographing stage.

8. A desk-type lighting apparatus according to claim 7, wherein said storage desk section has a storage space for storing said lighting units.

9. A desk-type lighting apparatus according to claim 7, wherein said back screen is hung from an upper end of said lid section.

10. A desk-type lighting apparatus according to claim 9, wherein said back screen is formed of resin film, paper, or cloth.

11. A desk-type lighting apparatus comprising:

a storage desk section including power supplies, a plurality of lighting units connected to said power supplies, and a photographing stage, said storage desk section having a storage space for storing said lighting units, said power supplies being fixedly disposed at a left-hand end and a right-hand end, respectively, of said storage space, said lighting units including lower lighting units connected directly to said power supplies, and upper lighting units connected to said power supplies via arm portions; and a lid section connected to said storage desk section such that said lid section can be opened and closed, said lid section including a back screen, said photographing stage being attached to said power supplies such that said photographing stage covers said lower lighting units and extends between said left-hand and right-hand power supplies, wherein when said lighting units are stored, said photographing stage is removed and stored within said lid section.

12. A desk-type lighting apparatus according to claim 11, wherein said photographing stage is a transparent acrylic plate.

13. A lighting apparatus, comprising:

a housing including a storage section and a lid connected to said storage section in a manner permitting opening of said housing from a storage position to a use position in which said housing is positionable such that said storage section serves as a base and said lid is at least partially upright;

at least one power supply disposed in said storage section;

lighting units connectable with said at least one power supply;

a photographing stage receivable to said storage section, said photographing stage including a surface on which a subject article to be lit may be supportably received; and a back screen positionable forward of said lid when said housing is in said use position.

14. A lighting apparatus according to claim 13, wherein said back screen is hung from an upper end of said lid.

15. A lighting apparatus according to claim 13, wherein a lower portion of said back screen is extendable over said photographic stage.

16. A lighting apparatus according to claim 13, wherein said lighting units include upper lighting units, said upper lighting units including flexible arm portions attachable to said at least one power supply.

17. A lighting apparatus according to claim 13, wherein said storage section includes a storage space therein.

18. A lighting apparatus according to claim 17, wherein at least one power supply includes two power supplies fixedly disposed at a left-hand end and a right-hand end, respectively, of said storage space.

19. A lighting apparatus according to claim 17, wherein said storage space is suitably configured to accommodate said lighting fixtures.

* * * * *